US007424879B2

(12) United States Patent
Schlauch et al.

(10) Patent No.: US 7,424,879 B2
(45) Date of Patent: Sep. 16, 2008

(54) PORTABLE HANDHELD WORK APPARATUS

(75) Inventors: Patrick Schlauch, Esslingen (DE); Jens Kern, Waiblingen (DE); Hans Nickel, Cottenweiler (DE); Helmut Zimmermann, Berglen (DE); Claus-Peter Hamisch, Esslingen (DE); Reiner Kuppert, Filderstadt (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 210 days.

(21) Appl. No.: 11/252,601

(22) Filed: Oct. 19, 2005

(65) Prior Publication Data

US 2006/0107533 A1 May 25, 2006

(30) Foreign Application Priority Data

Oct. 30, 2004 (DE) ..... 10 2004 052 785

(51) Int. Cl.
*F02M 35/02* (2006.01)

(52) U.S. Cl. ..... 123/198 E; 30/381

(58) Field of Classification Search ..... 123/198 E, 123/195 C, 41.65, 47.7; 30/381; 292/152; 220/326

See application file for complete search history.

(56) References Cited

U.S. PATENT DOCUMENTS

| | | | | |
|---|---|---|---|---|
| 5,595,153 | A | 1/1997 | Hoppner et al. | |
| 5,706,968 | A * | 1/1998 | Riley | 220/326 |
| 6,554,327 | B1 * | 4/2003 | Riley | 292/152 |
| 6,575,131 | B2 * | 6/2003 | Brister | 123/198 D |

* cited by examiner

*Primary Examiner*—Stephen K. Cronin
*Assistant Examiner*—Hyder Ali
(74) *Attorney, Agent, or Firm*—Walter Ottesen

(57) ABSTRACT

A portable handheld work apparatus includes a drive motor configured as an internal combustion engine (1). The work apparatus includes an air filter case (2) arranged in the intake channel of the engine (1). The work apparatus further includes a cover (3) and a locking device (4) for releasably holding the cover (3). An actuating element (6) of the locking device (4) is configured as a slider (7) which is guided so that it is essentially linearly movable.

16 Claims, 4 Drawing Sheets

PORTABLE HANDHELD WORK APPARATUS

CROSS REFERENCE TO RELATED APPLICATION

This application claims priority of German patent application no. 10 2004 052 785.7, filed Oct. 30, 2004, the entire content of which is incorporated herein by reference.

BACKGROUND OF THE INVENTION

Portable handheld work apparatus, such as motor-driven chain saws, brushcutters, cutoff machines or the like, are used under ambient conditions having high dust and dirt loads. A drive motor of the work apparatus configured as an internal combustion engine draws combustion air via an intake channel. This air is conducted through an air filter for separating dust entrained with the air flow. An air filter of this kind is held in an air filter case which is closed by means of a releasable cover. From time to time, the dust load of the air filter requires a cleaning or an exchange of the air filter and, for this purpose, the cover of the air filter case is to be opened. The same applies for checking and exchanging a spark plug which, together with the cylinder head, can likewise be covered. A simple opening and closing of the cover is wanted for uncomplicated maintenance work.

A portable handheld work apparatus is disclosed in U.S. Pat. No. 5,595,153 and this work apparatus has a filter case and cylinder head covered by a pivotable cover. For latching or for releasing the cover, various actuating elements of a locking device are suggested which permit a manual opening or closing of the cover without tools. A bayonet-like rotatable closure knob or, alternatively, a latch key is provided for locking or unlocking the cover. The actuation of such locking devices requires some sensitivity when doing maintenance work in the outdoors. An opening or closing of the cover can be difficult with cold hands and/or with work gloves.

SUMMARY OF THE INVENTION

It is an object of the invention to provide a portable handheld work apparatus wherein the performance of maintenance work is simplified.

The portable handheld work apparatus of the invention is a motor-driven chain saw, brushcutter, cutoff machine or the like. The work apparatus includes: an internal combustion engine defining an intake channel; an air filter case mounted in the intake channel; a cover; a locking device for releasably holding the cover; the locking device including an actuating slider; and, the slider being guided so as to be essentially linearly movable.

A portable handheld work apparatus having a cover and a locking device for the cover is suggested which is especially configured as a hood for the air filter case. An actuating element of the locking device is configured as an essentially linearly moveably guided slider. It has surprisingly been shown that the actuation of the slider on a linear movement path can be undertaken easily and without much concentration even outdoors under cold or damp ambient conditions. An opening and closing of the cover for maintenance work can be easily undertaken at the work site without tools and even while using work gloves. This maintenance work can, for example, be on the spark plug and especially on the air filter. Neither a large force nor special sensitivity is required. Faulty manipulation especially when latching the cover in its closed position is avoided.

In an advantageous further embodiment of the invention, the locking device includes an essentially linearly moveably guided latching bar and the slider and latching bar are especially configured as one part. The movement of the slider is transmitted without deflection directly and without play to the latching bar. The linear actuating position of the slider signals clearly and without doubt to the user the position of the latching bar.

In an advantageous embodiment, a latching device is provided for fixing the locking device in an opened position and in a closed position. The position of the locking device is precisely defined in each of the opened and closed positions by means of the latching device. Unwanted intermediate positions are avoided. An inadvertent opening of the latching device from its closed position is reliably prevented as is an inadvertent closing from the opened position. An increased operational reliability results in the closed position. In the open position, maintenance work is facilitated because of the avoidance of an unwanted latching of the cover.

The latching device includes two inclined surfaces, which are angled toward each other, and a latch spring which interacts with the inclined surfaces. The inclined surface, which is assigned to the closed position of the locking device, opens into a latch slot for the latch spring. The inclined surfaces are angled in opposition to each other and have a roof-like shape. These inclined surfaces in combination with the latch spring lying thereagainst combine to support the locking device in its movement out of an intermediate position to the closed position or the open position. In the transition from the one position to the other position, the latch spring must be lifted against its pretensioning force by means of the at first bordering inclined surface until the spring can slide on the following inclined surface. A precisely defined actuation threshold can be pregiven by the constructive matching of the inclined surface angle and the spring force. An unintended shifting is avoided below this actuating threshold. When closing, the latch spring slides along the assigned inclined surface until it snaps into the bordering latch slot. The latch slot effects an additional holding force of the latch spring on the locking device. An inadvertent release of the cover is avoided even under rough operating conditions. The cover is reliably held closed whereby the operating reliability of the work apparatus is increased.

The latching device engages on the linearly moveably guided latching bar. The positioning of the latching bar is thereby ensured directly at the location of the acting closing forces without detour and while avoiding elastic influences.

In an advantageous embodiment, the linearly moveably guided latching bar is configured as a spring pretensioned catch. An inclined surface, which operates on the catch when closing the cover, is especially provided on a side of the air filter case, on the motor housing or on a component assigned to the motor or to the motor housing. The catch is pushed linearly against the spring biasing thereof for opening the cover. The cover is unlatched and is opened. When releasing the actuating element, the actuating element snaps back into its rest position under the action of its spring pretensioning. When closing the cover, the cover need only be pressed into its closed position without additional manual or active actuation of the locking device. The inclined surface at the housing displaces the catch automatically so far that it can engage in a corresponding latch opening or the like with a further closing of the cover under the action of the spring pretensioning. The closing operation of the cover is limited to a pressing in the closing direction and a manual movement of the actuating element is not required.

The actuating element advantageously has a finger recess or cavity and/or a surface structuring. The surface structuring can be within and/or outside of the finger cavity. The finger cavity and the surface structuring permit, in combination or even independently of each other, a good manual introduction of force. Various mechanisms for introducing force are available to the user in dependence upon different operating conditions or personal preferences.

In a preferred embodiment, the cover is mounted so as to be pivotable in an up-direction on the motor housing. Referred to the up-direction, the actuating element is arranged above and especially approximately centered on the cover. To open the actuating element, pressure is carried out with the finger of one hand in order to be able to effect a lateral displacement. The finger pressure acts simultaneously also on the cover in a direction opposite to the pivot-opening direction and leads to a relaxation of the latch. The actuating element is movable with little force.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
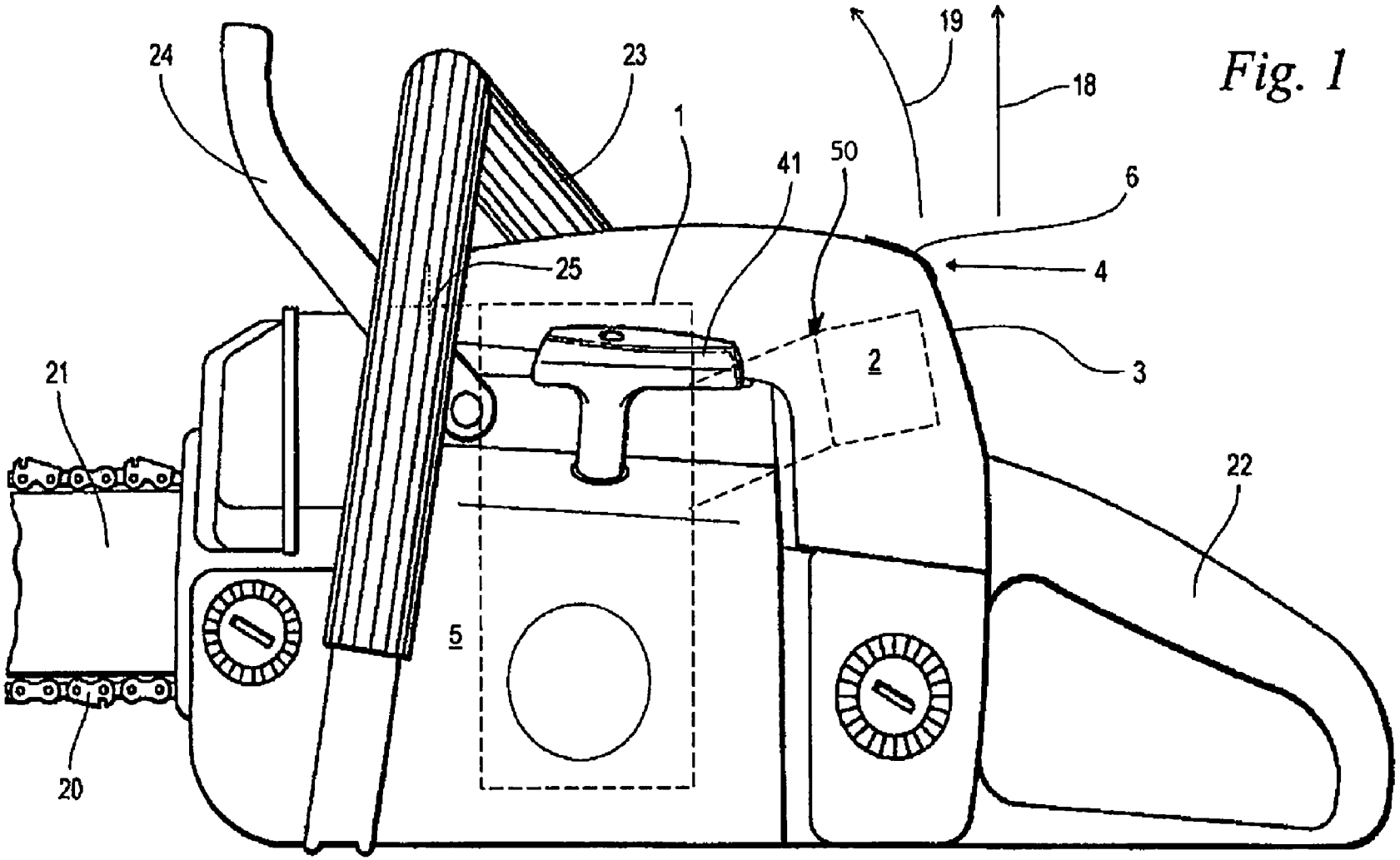
FIG. 1 is a side elevation view of a portable handheld work apparatus which is here shown as a chain saw equipped with a pivotable cover.

The overview diagram of FIG. 1 shows a portable handheld work apparatus which, here, is a chain saw by way of example. The work apparatus can also be a brushcutter, cutoff machine or the like. The chain saw is provided with a motor housing 5 on which a guide bar 21 is attached having a saw chain 20 which runs about the periphery of the guide bar. A drive motor in the form of an internal combustion engine 1 is mounted in the housing and is shown in phantom outline. The saw chain 20 is driveable by means of the drive motor. A pull-rope starter 41 is provided for starting the engine 1. A rearward handle 22 and a forward handle 23 are attached to the motor housing 5 for guiding the chain saw. A brake lever 24 is provided forward of the forward handle 23. A braking device is triggered by the brake lever 24 for bringing the saw chain 20 to standstill.

During operation, the engine 1 draws combustion air through an intake channel 50. Fuel is supplied to the combustion air flow in a carburetor (not shown) and an ignitable air/fuel mixture is formed. An air filter for cleaning the combustion air flow is provided upstream of the carburetor. The exchangeable air filter is held in an air filter case 2. The cylinder head of the engine 1 having a threadably engaged spark plug and the air filter case 2 are covered with a cover 3 during operation. The cover 3 forms a hood for the air filter case 2 and protectively engages around the air filter case 2 without hindering the supply of combustion air. In addition to the purely covering function, the cover 3 can also carry out a function of fixing an air filter or its cover on the air filter case 2. It can also be practical to assign a cover 3 of its own to the air filter case 2 and/or the engine 1 and/or another component of the work apparatus.

In addition, the cover 3 is attached to the motor housing 5 by means of a pivot support in the region of the forward handle 23 and is pivotally journalled about a pivot axis 25. After releasing the locking device 4, the cover 3 can pivot open in the direction of arrow 19 about the pivot axis 25. In the open-pivoted state, a free access to the air filter case 2 is provided. An up-direction 18 is pregiven by the pivot direction indicated by the arrow 19. An actuating element 6 of the locking device 4 is mounted up on the cover 3 referred to the up-direction 18.

Figure 2:
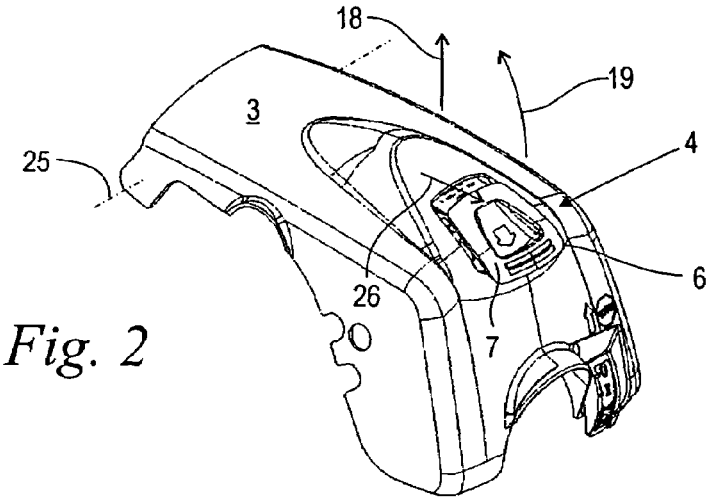
FIG. 2 is a perspective view showing details of the cover of the work apparatus of FIG. 1 having a linearly displaceable actuating element.

The cover 3 of the work apparatus of FIG. 1 is shown in a perspective view in FIG. 2. In FIG. 2, the actuating element 6 is arranged, referred to the lateral direction, midway on the cover 3 and this lateral direction is pregiven by the pivot axis 25. The actuating element 6 is configured as a slider 7 which is pushed out of the cover 3 in a direction indicated by arrow 26 and lying perpendicular to the pivot axis 25 and to the up-direction 18. In the position of the slider 7 shown, the cover 3 is released from the motor housing 5 (FIG. 1) and can be flipped or pivoted open about the pivot axis 25 in the pivot direction 19.

Figure 3:
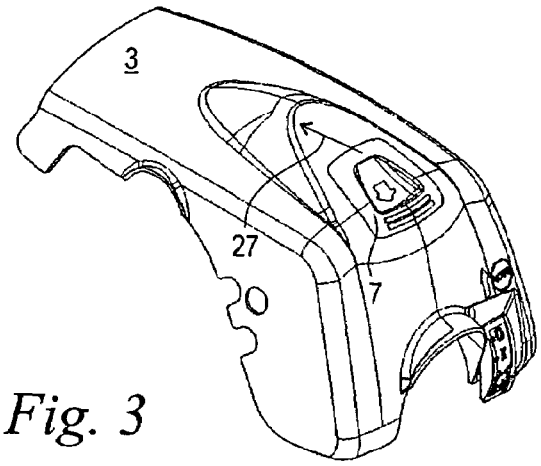
FIG. 3 shows the cover of FIG. 2 with the actuating element in the closed position.

FIG. 3 shows the arrangement of FIG. 2 wherein the slider 7 is displaced linearly into a closing position in the opposite direction indicated by arrow 27. In the closing position shown, the locking device 4 (FIG. 1) is latched. The cover 3 is fixed on the motor housing 5. In the closed position of the slider 7 shown, the outer contour of the slider fits into the outer contour of the cover 3 so that essentially no projecting parts result. An unintended actuation of the slider 7 is avoided.

Figure 4:
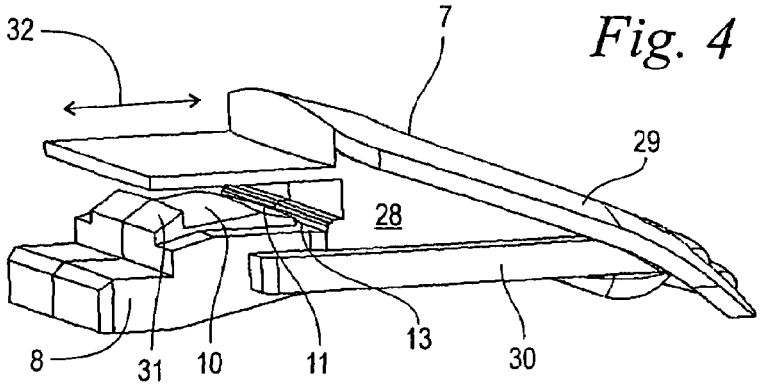
FIG. 4 is an enlarged perspective view showing the actuating element of FIGS. 2 and 3 configured as a slider with details for arranging an actuating plate and a latching bar.

FIG. 4 shows a component in an enlarged perspective view and this component includes the slider 7 described with respect to FIGS. 1 to 3. The slider 7 as well as a latching bar 8 are formed as one part on a base body 28. The slider 7 includes an actuating plate 29 which can be actuated from outside the cover 3 (FIGS. 1 to 3) by a person operating the work apparatus. The latching bar 8 lies within the cover 3.

Slide rails 30 are formed laterally on the base body 28 by means of which the slider 7 together with the latching bar 8 are linearly displaceable in the direction of a double arrow 32 in the cover 3. The cover 3 and the component made up of the slider 7 and the latching bar 8 are manufactured from injection molded plastic. The friction pairing POM/PA6-GF30 is selected. Preferably, the slider 7 is made of POM and the cover 3 is made of PA6-GF30.

Two mutually oppositely angled inclined surfaces (10, 11) are formed on the latching bar 8 and these surfaces extend with mutually opposite inclinations referred to the double arrow 32. The forward inclined surface 10 is limited by a stop 31 in the direction of the free end of the latching bar 8. In the opposite direction, the rearward inclined surface 11 opens into a latch slot 13.

The operation of the component of FIG. 4 together with the cover 3 of FIGS. 1 to 3 is described in greater detail in connection with FIGS. 5 and 6.

Figure 5:
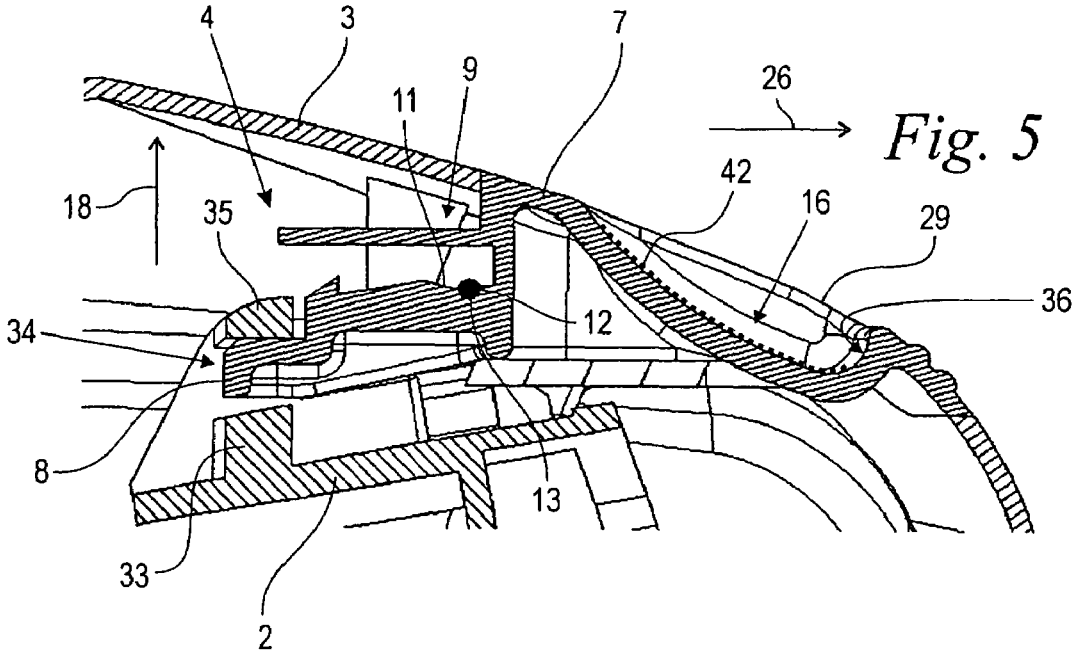
FIG. 5 is a detail longitudinal section view of the closed cover in the area of the latched slider.

The longitudinal section view of FIG. 5 shows that the component made up of the slider 7 and the latching bar 8 is pushed into the closed position of FIG. 3 referred to the cover 3. The locking device 4 for the cover 3 includes a latching wall 33 in addition to the slider 7 and the latching bar 8. This latching wall 33 is attached to the air filter case 2 and a latching bar opening 34 is formed in the latching wall 33. The latching wall 33 can also be attached to the motor housing 5 or to a component of the internal combustion engine 1 (FIG. 1). A strut 35 is formed from the latching wall 33 by the arrangement of the latching bar opening 34. The latching bar 8 engages in the latching bar opening 34 and lies below and against the strut 35 referred to the up-direction 18. The contact engagement of the latching bar 8 on the strut 35 effects a form-tight latching of the cover 3 to the motor housing 5 in the region of the locking device 4.

In the direction opposite to the up-direction 18, a small vertical play is provided between the latching bar 8 and the latching wall 33 within the latching bar opening 34. As a consequence of this play, the latching bar 8 can be released with a vertical pressure on the slider 7 away from the strut 35 which simplifies a displacement of the slider 7 in the opening direction 26 for unlatching the cover 3. The latching bar 8 lies with a slight pretensioning against the strut 35 in the up-direction 18 in the absence of external forces. The vertical pretensioning can, for example, be effected by a rubber-elastic support of the cover 3 or by its elastic material characteristics.

A further part of the locking device 4 is a latching device 9 which includes a latch spring 12 fixed to the cover in addition to the inclined surfaces (10, 11) (FIG. 4). The latch spring 12 is configured as an elastic spring wire running transversely through the cover 3 and the wire coacts with the inclined surfaces (10, 11) of the latching bar 8. In the shown closed position of the slider 7 or the latching bar 8, the latch spring 12 lies in the latch slot 13. To open the slider 7 in the opening direction 26, a corresponding hand force is to be applied to the slider 7 which is sufficient so that the latch spring 12 is lifted out of the latch slot 13 and glides over the inclined surface 11. To open in the direction of arrow 26, a force is to be applied which is so great that the latch spring 12 first overcomes the latch slot 13 and thereafter the inclined surface 11 assigned to the closed position.

A finger cavity 16 is formed in the actuating plate 29 for manually actuating the slider 7. A rearward section 36 of the finger cavity 16 lies in the opening direction 26. This rearward section 36 of the finger cavity is concavely formed in such a manner that the surface of the cavity lies approximately perpendicular to the opening direction 26. With a finger engaging in the finger cavity 16, a correspondingly high manual force can be developed in the direction of arrow 26 at the rearward section 36 to open the slider 7. A surface structuring 42 is provided in the finger cavity 16 to support the application of this manual force.

Figure 6:
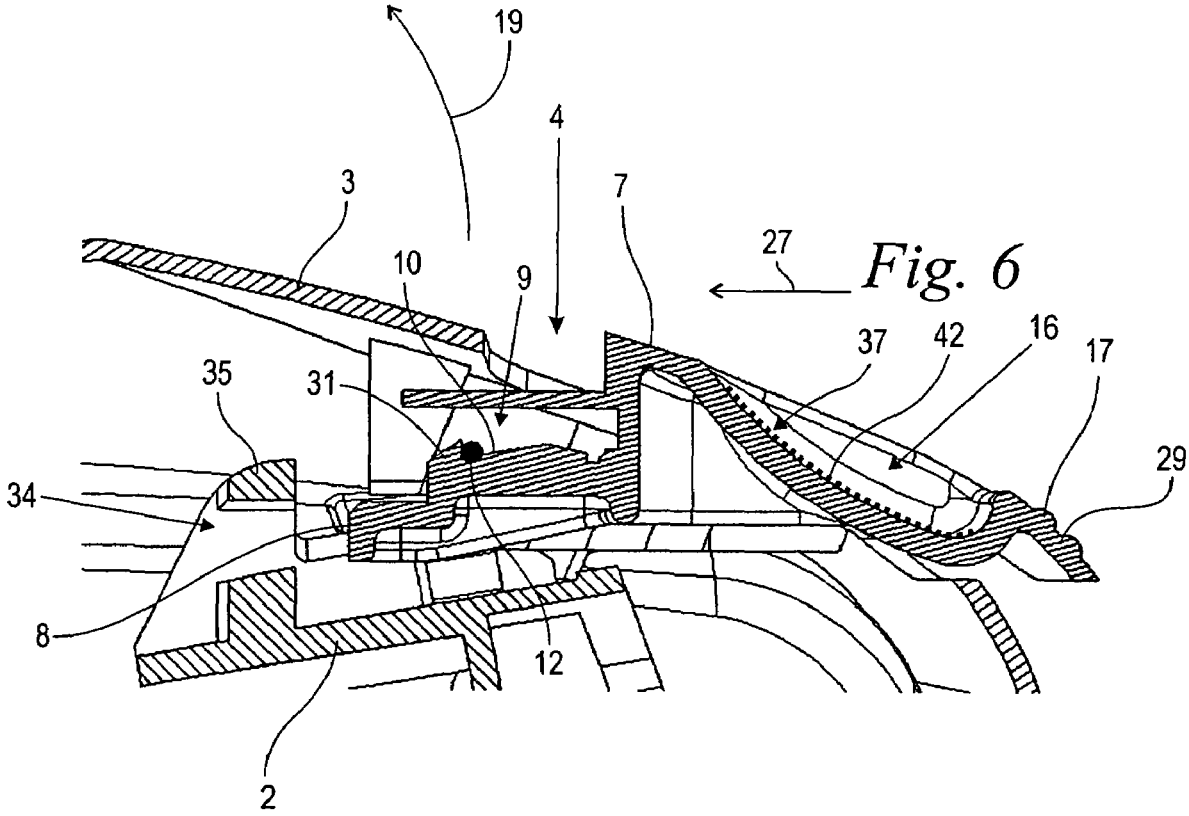
FIG. 6 shows the arrangement of FIG. 5 with an unlatched slider.

FIG. 6 shows an arrangement of FIG. 5 with the slider 7 and the latching bar 8 in the open position. The slider 7 and the latching bar 8 are displaced in the opening direction 26 (FIG. 5) relative to the cover 3. The latching bar 8 no longer is in engagement with the latching bar opening 34, that is, the strut 35 of the motor housing 5. The latch spring 12 is held tightly in position with respect to the cover 3. During the displacing operation of the slider 7, the latch spring 12 glidably slips on the additional inclined surface 10 under a vertical pretensioning until the stop 31 lies against the latch spring 12 and a further opening movement of the slider 7 is prevented. In the open position of the slider 7 and latching bar 8 shown, the cover 3 can be pivoted upwardly in the pivot direction 19.

For closing and latching the cover 3, the slider 7 is pushed in the closing direction 27. The inclined surface 10 of the latching bar 8 glides below the latch spring 12 pretensioned downwardly vertically. In the open position of the slider 7 and latching bar 8 shown, the forward inclined surface 10 and the latch spring 12 as part of the latching device 9 effect a latch holding of the locking device 4 in the open position.

To close the slider 7, the operator can apply pressure with a finger on a forward section 37 of the finger cavity 16 having the surface structuring 42 or on a surface structuring 17 arranged outside of the finger cavity 16 on the actuating plate 29. Likewise, it can be practical to arrange the latching device 9 to act directly on the slider 7.

Figure 7:
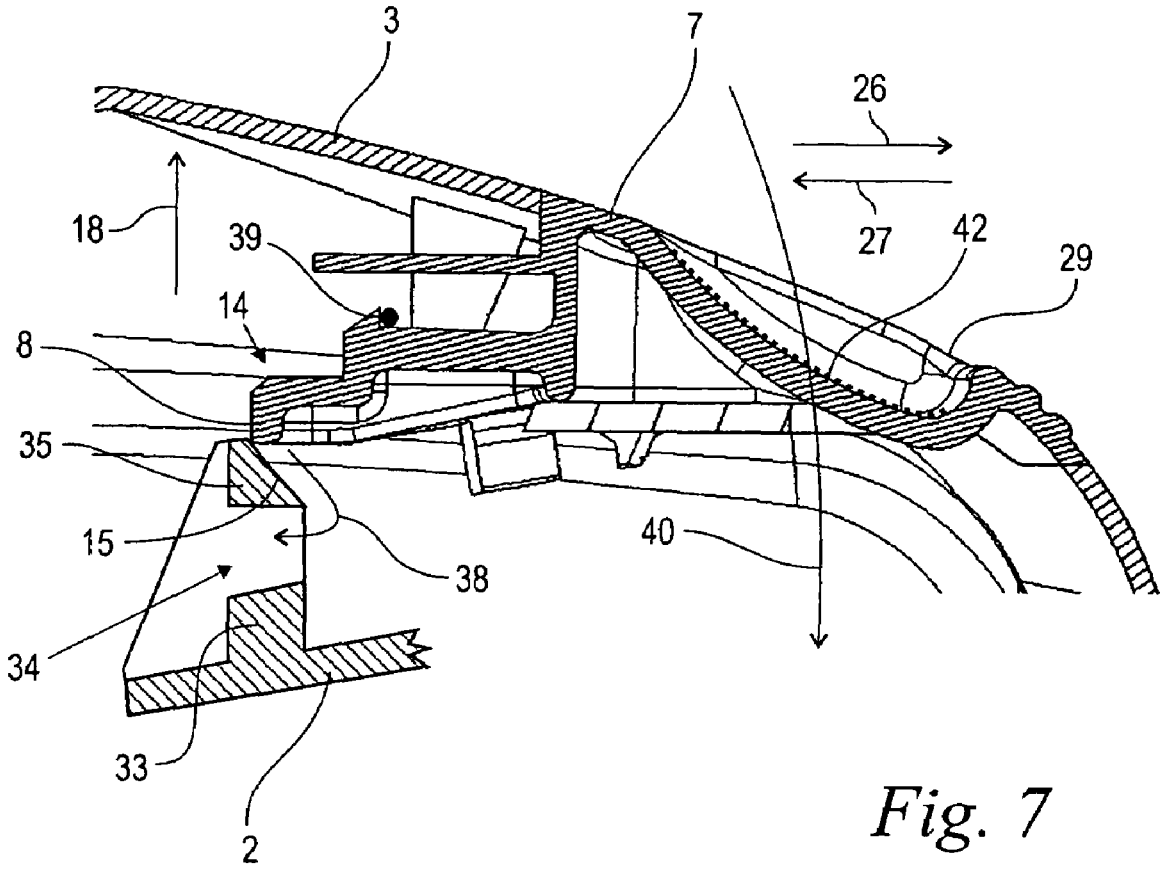
FIG. 7 shows a variation of the arrangement of FIGS. 5 and 6 with a latching bar configured as a catch.

FIG. 7 shows a variation of the arrangement of FIGS. 5 and 6 wherein the latching bar is configured as a spring pretensioned catch 14 with the latching bar being linearly movable. A spring 39 is provided which is attached to the cover 3. In the embodiment shown, the spring 39 runs as a wire spring transversely through the cover 3 and the unit of slider 7 and latching bar 8 is pretensioned in the closing direction 27. The strut 35 of the air filter case 2 is provided with an inclined surface 15 which coacts with the catch 14. When there is a pivoting closing operation of the cover 3 in the direction of arrow 40, the catch 14 comes into contact engagement with the inclined surface 15 of the strut 35. When further closing the cover 3 in the direction of arrow 40, the inclined surface 15 effects a linear displacement of the unit made up of the slider 7 and the latching bar 8 in the opening direction 26. The latching bar 8 then glides along the inclined surface 15 in the direction of arrow 38. The latching bar 8 first experiences a combined deflection in the opening direction 26 opposite to the pretensioning force of the spring 39 as well as a vertical component of movement in a direction opposite to the up-direction 18. When reaching the closing position of the cover 3, the pretensioning force of the spring 39 effects an automatic latching of the catch 14 in the latching bar opening 34 along the direction of movement indicated by the arrow 38. In the last-mentioned movement segment, the catch 14 is linearly displaced in the closing direction 27 under the action of the spring 39. It can also be practical to alternatively or in combination provide the catch 14 with an inclined surface 15. The remaining elements have the same reference numerals in FIG. 7 as in the previous FIGS.

It is understood that the foregoing description is that of the preferred embodiments of the invention and that various changes and modifications may be made thereto without departing from the spirit and scope of the invention as defined in the appended claims.

What is claimed is:

1. A portable handheld work apparatus including a motor-driven chain saw, brushcutter or cutoff machine, the work apparatus comprising:

an internal combustion engine defining an intake channel;

an air filter case mounted in said intake channel;

a cover;

a locking device for releasably holding said cover;

said locking device including an actuating slider;

said slider being guided so as to be essentially linearly movable; and, said slider including an actuating plate having a finger cavity formed therein for facilitating manual actuation of said slider.

2. The work apparatus of claim 1, wherein said cover is a hood for said air filter case.

3. The work apparatus of claim 2, further comprising a housing for said internal combustion engine; said cover being pivotally mounted on said housing for pivoting upwardly about a pivot axis defining a lateral direction relative to said housing in an up-direction from a first position to a second position; and, said actuating slider being arranged approximately in a mid region of said cover referred to said up-direction and referred to said lateral direction.

4. The work apparatus of claim 1, wherein said slider is movable relative to said cover between a first position whereat said cover is held closed and a second position whereat said cover can be opened;

said cover having an outer surface and said actuating plate having an outer surface wherein said cavity is formed; and, said outer surface of said cover and said outer surface of said actuating plate being flush when said slider is in said first position so as to cause no structure to extend above said outer surfaces.

5. A portable handheld work apparatus including a motor-driven chain saw, brushcutter or cutoff machine, the work apparatus comprising:

an internal combustion engine defining an intake channel;

an air filter case mounted in said intake channel;

a cover;

a locking device for releasably holding said cover;

said locking device including an actuating slider;

said slider being guided so as to be essentially linearly movable;

said locking device further including a latching bar guided so as to be essentially linearly movable;

said locking device further including a latching device for fixing said locking device in an open position and in a closed position; and, said latching device further including a latch spring and first and second mutually oppositely inclined surfaces for interacting with said latch spring.

6. The work apparatus of claim 5, wherein said latching bar and said slider are configured as a single part.

7. The work apparatus of claim 5, wherein said latching device includes a latch slot for the latch spring; and, one of said inclined surfaces corresponds to said closed position of said latching device and opens into said latch slot.

8. The work apparatus of claim 7, wherein said latching device engages on said latching bar.

9. A portable handheld work apparatus including a motor-driven chain saw, brushcutter or cutoff machine, the work apparatus comprising:

an internal combustion engine defining an intake channel;

an air filter case mounted in said intake channel;

a cover;

a locking device for releasably holding said cover;

said locking device being configured as an actuating slider;

said slider being guided so as to be essentially linearly movable; and, said locking device further including a latch guided so as to be essentially linearly movable and said latch being configured as a spring-biased catch.

10. The work apparatus of claim 9, wherein said air filter case has an inclined surface for acting on said spring-biased catch when said cover is closed.

11. The work apparatus of claim 10, wherein said actuating slider includes a finger cavity.

12. The work apparatus of claim 11, wherein said actuating slider is provided with a surface structuring.

13. The work apparatus of claim 12, wherein said surface structuring is provided outside of said finger cavity.

14. The work apparatus of claim 12, wherein said surface structuring is provided within said finger cavity.

15. The work apparatus of claim 11, wherein said slider is movable relative to said cover between a first position whereat said cover is held closed and a second position whereat said cover can be opened;

said cover having an outer surface;

said actuating slider having an outer surface wherein said cavity is formed; and, said outer surface of said cover and said outer surface of said actuating plate being flush when said slider is in said first position so as to cause no structure to extend above said outer surfaces.

16. A portable handheld work apparatus including a motor-driven chain saw, brushcutter or cutoff machine, the work apparatus comprising:

an internal combustion engine defining an intake channel;

an air filter case mounted in said intake channel;

a cover;

a locking device for releasably holding said cover;

said locking device including an actuating slider;

said slider being guided so as to be essentially linearly movable;

said locking device further including a latching device for fixing said locking device in an open position and in a closed position; and, said latching device including a latch spring configured as an elastic spring wire extending transversely through said cover.

* * * * *

UNITED STATES PATENT AND TRADEMARK OFFICE

CERTIFICATE OF CORRECTION

PATENT NO. : 7,424,879 B2
APPLICATION NO. : 11/252601
DATED : September 16, 2008
INVENTOR(S) : Patrick Schlauch et al.

It is certified that error appears in the above-identified patent and that said Letters Patent is hereby corrected as shown below:

In column 4:

Between Line 8 and Line 9: Insert the paragraph:

-- In its closed position, the cover 3 is fixed with a locking device 4 in its closed position relative to the motor housing 5 and to the air filter case 2. The locking device is described in greater detail hereinafter. --

Signed and Sealed this

Twenty-third Day of December, 2008

JON W. DUDAS
*Director of the United States Patent and Trademark Office*